US006688753B2

(12) United States Patent
Calon et al.

(10) Patent No.: US 6,688,753 B2
(45) Date of Patent: Feb. 10, 2004

(54) INTEGRATED LIGHT SOURCE

(75) Inventors: Georges Marie Calon, Eindhoven (NL); Josephus Theodorus Van Der Eyden, Eindhoven (NL); Annemarie Paulien Buddemeijer-Lock, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 8 days.

(21) Appl. No.: 10/066,447

(22) Filed: Jan. 31, 2002

(65) Prior Publication Data

US 2002/0118538 A1 Aug. 29, 2002

(30) Foreign Application Priority Data

Feb. 2, 2001 (EP) ..... 01200384

(51) Int. Cl.[7] ..... F21V 1/00

(52) U.S. Cl. ..... 362/236; 362/234; 362/249; 362/276; 362/544

(58) Field of Search ..... 362/228, 234, 362/236, 240, 238, 263, 276, 802, 229, 249, 264, 543, 544, 545

(56) References Cited

U.S. PATENT DOCUMENTS 5,711,591 A * 1/1998 Jordan ..... 362/477

FOREIGN PATENT DOCUMENTS

EP 2334832 A 9/1999 ..... H05B/37/02
WO WO9953236 10/1999 ..... F21S/1/02

* cited by examiner

*Primary Examiner*—Sandra O'Shea
*Assistant Examiner*—John Anthony Ward
(74) *Attorney, Agent, or Firm*—Ernestine C. Bartlett

(57) ABSTRACT

The lighting unit comprises a first lighting element (10) and a second lighting element (11). In operation, the first lighting element (10) has a comparatively high light output. The second lighting element (20, 20') has a light output, in operation, which is relatively low in comparison with that of the first lighting element (10). The lighting unit comprises a control mechanism (40) including a switching means with a toggle function that is responsive to sequential switches in the power applied to the lighting unit. By selecting the proper switching sequence, either the first lighting element or the second lighting element or both lighting elements are switched on. Preferably, the first lighting element is a compact fluorescent discharge vessel (10), and the second lighting element comprises a plurality of LEDs (20, 20'). The lighting unit enables remote-controlled switching between orientation light (night lamp) and normal light, using the toggle function in the lighting unit.

20 Claims, 2 Drawing Sheets

INTEGRATED LIGHT SOURCE

Figure 1:
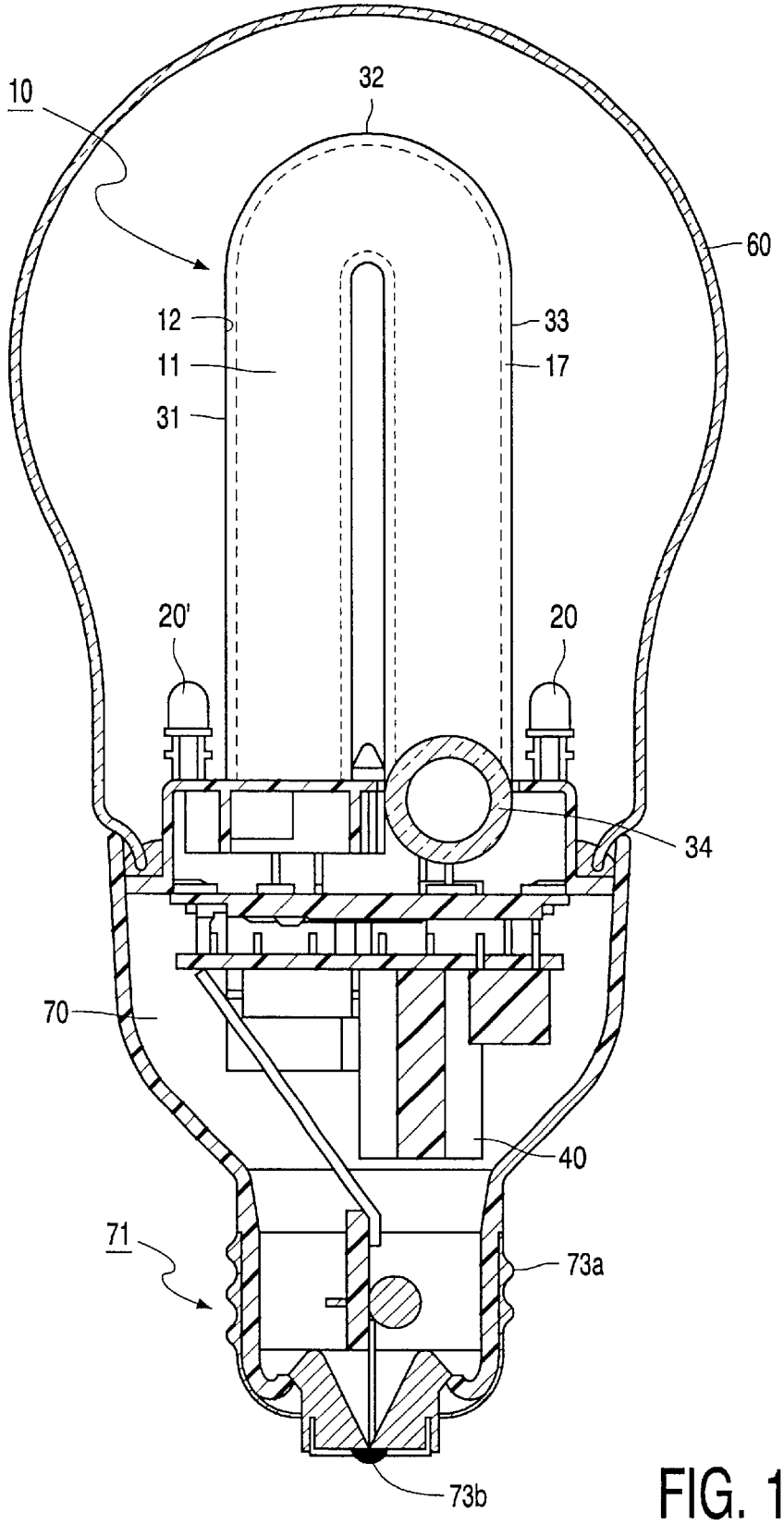

The invention relates to an integrated light source comprising a first light-emitting element and a second light-emitting element.

An integrated light source of the type mentioned in the opening paragraph is known from WO 99/53236. In this document a description is given of a color illuminating unit comprising a lamp which, in operation, is connected to the mains voltage, and a plurality of blue, green and red light-emitting elements which, in operation, are operated at a voltage that is low as compared to the rated mains voltage.

A drawback of the known integrated light source resides in that said integrated light source cannot be operated in a convenient way.

It is an object of the invention to provide an integrated light source of the type mentioned in the opening paragraph, which can be operated in a more convenient way.

This object is achieved in accordance with the invention in that,

- the first light-emitting element has, in operation, a comparatively high light output,
- the second light-emitting element has, in operation, a light output which is relatively low in comparison with that of the first light-emitting element, and
- the integrated light source is further provided with a control mechanism comprising means that are responsive to sequential changes in voltage, so that, at the user's choice, at least one of the light-emitting elements can be switched on or off.

The use of the control mechanism in accordance with the invention enables a user of the integrated light source to sequentially change the voltage through the integrated light source by making use of a light switch that is situated at a distance from the light source. This has the advantage that, even if the integrated light source in accordance with the invention is provided in places that are difficult to reach, switching between the different lighting states of the integrated light source can still be carried out in a convenient way. If the known integrated light source is provided in a room in such a manner that the light source is difficult to reach, for example because the light source is in a comparatively high position (for example attached to, or in the vicinity of the ceiling of the room), changing the voltage through the integrated light source at the location of said integrated light source is inconvenient. Auxiliary means (for example a stepladder) may be needed to switch between the different illumination states of the integrated light source. This may give rise to risky situations. In addition, in operation, the integrated light source may be hot, which may lead to problems when the user touches the integrated light source to change the voltage through the light source in order to switch on and off the light-emitting elements. By suitably using the light switch that is known per se, which is provided, for example, on a wall of the room or is switched, for example, by means of a remote control, the control mechanism in accordance with the invention enables the desired light level to be attained.

In the description of the invention, the expression "sequential changes in voltage" is to be taken to mean that the voltage level is changed, for example, by sequentially switching on or off the voltage through the integrated light source. The voltage can be changed in an alternative way, for example, by reducing the voltage through the integrated light source to at least 80% or to 50% of the voltage, for example, by using a dimmer switch.

The control mechanism comprises means which are known per se for reacting to a certain sequence of changes in the voltage through the integrated light source. Said means comprise, preferably, a comparatively straightforward electronic circuit with a so-termed toggle-switch, which is responsive to, for example, the sequential switching on and off of the voltage. Dependent upon the time that elapses between changing the state of the light switch and returning the light switch to the original state, the settings of the control mechanism determine whether one or both integrated light-emitting elements will start emitting light.

The use of the control mechanism in combination with the application of a first light-emitting element having a comparatively high light output and a second light-emitting element having a comparatively low light output has the advantage that the integrated light source can be used as a normal lamp and as a so-termed night lamp. Night lamps are used, inter alia, as orientation lighting (for example for security purposes) and as a light-emitting element for increasing the sense of comfort or safety, for example in a nursery. A drawback of the night lamp that is known per se resides in that it generally has a very low light output, i.e. the night lamp itself is visible when it is switched on, but it spreads comparatively little light to its surroundings. The use of an integrated light source as a night lamp has the advantage that the light output in the night position is comparatively higher than that of the known night lamp, so that a satisfactory orientation in relation to the surroundings is possible.

An important advantage of the integrated light source in accordance with the invention resides in that the integrated light source is retrofit for an existing lamp, and further adaptations to bring about the switching states of the integrated light source are not necessary. At the location where a normal lamp is provided in a room, this lamp is removed from the luminaire and substituted with the integrated light source in accordance with the invention. The switching possibilities do not require any further adaptation; even the light switch present in the room does not have to be adapted.

A preferred embodiment of the integrated light source is characterized in that the first light-emitting element comprises a low-pressure mercury vapor discharge vessel and the second light-emitting element comprises at least one light-emitting diode.

In general, it is rather difficult to satisfactorily or sufficiently dim a low-pressure mercury vapor discharge lamp. As a result, a low-pressure mercury vapor discharge lamp is comparatively unsuitable for use as a night lamp. In addition, it has been found that even in the dimmed state of the low-pressure mercury vapor discharge lamp, the light level generally is too high, so that said discharge lamp cannot suitably be used as a night lamp. It is convenient to combine the low-pressure mercury vapor discharge lamp with one or more light-emitting diodes (LEDs). LEDs have a comparatively low light output, are cheap in terms of energy consumption and have a very long service life. For the light-emitting diodes use can be made of white LEDs or colored LEDs, for example red, green, orange and/or blue LEDs. According to the desired application of the integrated light source, LEDs of various colors can be combined in an integrated light source. By switching off the low-pressure mercury vapor discharge lamp by means of the control mechanism, the LEDs having a comparatively low light output serve as a night lamp or as orientation lighting.

An alternative preferred embodiment of the integrated light source in accordance with the invention is characterized in that the first light-emitting element is surrounded by an outer bulb, the second light-emitting element being situated in the space between the first light-emitting element and the outer bulb. The outer bulb protects the first light-emitting element as well as the second light-emitting element, for example a plurality of LEDs. The second light-emitting element preferably comprises four LEDs.

In a further alternative embodiment of the integrated light source, the LEDs are directly provided on an electronic circuit in the housing, and an outer wall of the housing is provided with small apertures from which the LEDs project.

Preferably, the first light-emitting element comprises a compact low-pressure mercury vapor discharge vessel, and the second light-emitting element comprises at least one light-emitting diode. The invention particularly relates to a combination of a compact low-pressure mercury vapor discharge vessel with an outer bulb, with one or more LEDs being situated in the space between the outer bulb and the low-pressure mercury vapor discharge vessel. In this embodiment, the integrated light source has the appearance of an incandescent lamp, so that it is also referred to as an "incandescent lamp look-alike", the compact low-pressure mercury vapor discharge vessel and a number of LEDs being situated on the inside of the integrated light source, and being capable of being selectively switched on or off by using the switching properties of the control mechanism. The control mechanism is preferably provided in the housing of the integrated light source.

These and other aspects of the invention will be apparent from and elucidated with reference to the embodiment(s) described hereinafter.

Figure 2:
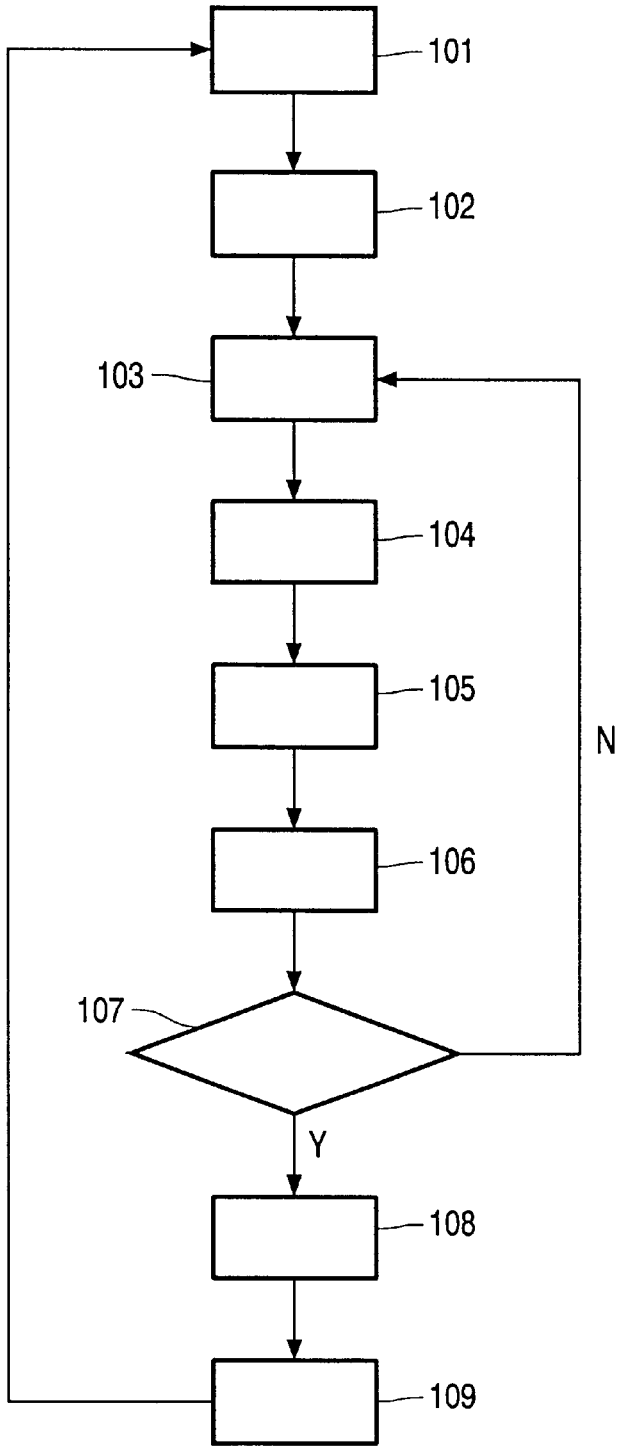

In the drawings:

FIG. 1 is a cross-sectional view of an example of an integrated light source in accordance with the invention, and FIG. 2 is an example of a flow chart of the toggle-switch.

The Figures are purely diagrammatic and not drawn to scale. Particularly for clarity, some dimensions are exaggerated strongly. Wherever possible, in the Figures, like reference numerals refer to like parts.

FIG. 1 is a cross-sectional view of an example of an integrated light source comprising a first light-emitting element, in this example a light-transmitting discharge vessel 10 of a compact low-pressure mercury vapor discharge lamp, also referred to as compact fluorescent lamp, and a second light-emitting element, in this example a plurality of light-emitting diodes 20, 20'. The second light-emitting element preferably comprises four LEDs. In operation, the first light-emitting element has a comparatively high light output. The second light-emitting element has, in operation, a light output that is relatively low in comparison with that of the first light-emitting element.

In this example, the discharge vessel 10 encloses a discharge space 11 having a volume of approximately 10 $cm^3$ in a gastight manner. The discharge vessel 10 is a glass tube having an at least substantially circular cross-section and an (effective) internal diameter of approximately 10 mm. The tube is bent so as to be hook-shaped and has, in this example, a number of straight parts, two straight parts 31, 33 of which are shown in FIG. 1. The tube further comprises a number of arc-shaped parts, two arc-shaped parts 32, 34 of which are shown in FIG. 1. An inner wall 12 of the discharge vessel 10 is provided with a luminescent layer 17. In an alternative embodiment, the luminescent layer is omitted. The discharge vessel 10 is supported by a housing 70, which also supports an integrated lamp cap 71 provided with electrical and mechanical contacts 73*a*, 73*b*, which are known per se. The discharge vessel 10 of the low-pressure mercury vapor discharge lamp is surrounded by a light-transmitting envelope or outer bulb 60, which is secured to the lamp housing 70. The outer bulb 60 generally has a mat appearance.

The housing 70 accommodates the electronic ballast of the integrated light source. The housing additionally accommodates a control mechanism 40 comprising means that are responsive to the sequential switching on and off of the voltage, as a result of which, at the user's choice, at least one of the light-emitting elements can be switched on or off.

The control mechanism 40 comprises means which are known per se for reacting to a specific sequence of switching on and off the integrated light source. The means preferably comprise a comparatively simple electronic circuit with a so-termed toggle-switch (not shown in FIG. 1) that is responsive to the sequential switching on and off of the voltage. Dependent upon the time that elapses between switching the light switch to the off-state and switching it back to the on-state, the settings of the control mechanism determine whether one or both integrated light-emitting elements start emitting light.

An important advantage of the integrated light source shown in FIG. 1 resides in that the integrated light source is retrofit for a compact fluorescent lamp, and further adaptations to bring about the switching states of the integrated light source are not necessary.

FIG. 2 shows an example of a flow chart of the toggle-switch. In the situation indicated by means of flow chart element 101, the light is switched off, i.e. both the first light-emitting element and the second light-emitting element are switched off. In the situation indicated by means of flow chart element 102, the mains switch is switched on. By switching on the mains switch, the second light-emitting element is switched on (see flow chart element 103), for example a plurality of LEDs. These LEDs emit light with a comparatively low light output. In the situation indicated by means of flow chart element 104, the mains switch is switched off again and the second light-emitting element is switched off, as a result of which the integrated light source no longer emits light (see flow chart element 105). In flow chart element 106, the mains switch is switched on again. Flow chart element 107 represents an option. If the time that elapses between switching off the integrated light source (see flow chart element 104) and switching on the integrated light source (see flow chart element 106) is shorter than, for example, three seconds (indicated by means of "Yes" in the flow chart of FIG. 2), then the first light-emitting element is switched on (see flow chart element 108). If the mains switch is switched off again (see flow chart element 109), the integrated light source is switched off and the system returns to the state indicated by means of flow chart element 101. If in the situation indicated by means of flow chart element 107, the time that elapses between switching off the integrated light source (see flow chart element 104) and switching on the integrated light source (see flow chart element 106) is longer than or equal to, for example, three seconds (indicated by means of "NO" in the flow chart diagram of FIG. 2) then the second light-emitting element is switched on (see flow chart element 103). The control mechanism 40 may be embodied such that if the first light-emitting element is in the switched-on state, the second light-emitting element is also in the switched-on state. In the example shown in FIG. 1, this means that if the first light-emitting element is a compact fluorescent lamp and the second light-emitting element comprises a plurality of LEDs, then the LEDs remain switched on when the fluorescent lamp is in the switched-on state, which can be attributed to the comparatively low current consumption and the long service life of the LEDs. In an alternative embodiment, the second light-emitting element is switched off if the first light-emitting element is in the switched-on state.

It will be clear that, within the scope of the invention, many variations are possible to those skilled in the art.

The scope of protection of the invention is not limited to the examples given hereinabove. The invention is embodied in each novel characteristic and each combination of characteristics. Reference numerals in the claims do not limit the scope of protection thereof. The use of the verb "to comprise" and its conjugations does not exclude the presence of elements other than those mentioned in the claims. The use of the article "a" or "an" in front of an element does not exclude the presence of a plurality of such elements.

What is claimed is:

1. An integrated light source comprising:

a first light-emitting element (10) having, in operation, a comparatively high light output, a second light-emitting element (20, 20') having, in operation, a light output which is relatively low in comparison with the light output of the first light-emitting element, and means for supplying electrical power to the integrated light source, characterized in that said means for supplying consists of a single means for receiving electrical power from a user-controllable source and supplying power to said light-emitting elements, and said single means comprises means (40), responsive to sequential changes in voltage applied to said single means, for switching one only of said light emitting elements (10, 20, 20') on, or switching at least the other of the light emitting elements (10, 20, 20') on.

2. The integrated light source claimed in claim 1, characterized in that said means for switching (40) is responsive to a sequential change in voltage level in the form of reduction in voltage level applied to said single means.

3. The integrated light source claimed in claim 1, characterized in that said single means comprises two electrical contacts only (73*a,* 73*b*).

4. The integrated light source claimed in claim 1, characterized in that said first light-emitting element (10) is surrounded by an outer bulb (60), and the second light-emitting element (20, 20') is situated in a space between the first light-emitting element and the outer bulb.

5. The integrated light source claimed in claim 1, characterized in that said first light-emitting element comprises a low-pressure mercury vapor discharge vessel (10), and the second light-emitting element comprises at least one light-emitting diode (20, 20').

6. The integrated light source claimed in claim 5, characterized in that said means for switching (40) is provided in a housing (70) of the integrated light source.

7. The integrated light source claimed in claim 5, characterized in that said first light-emitting element (10) is surrounded by an outer bulb (60), and the second light-emitting element (20, 20') is situated in a space between the first light-emitting element and the outer bulb.

8. The integrated light source claimed in claim 6, characterized in that said single means comprises two electrical contacts only (73*a,* 73*b*) for receiving electrical power.

9. An integrated light source comprising:

a first light-emitting element (10) having, in operation, a comparatively high light output, a second light-emitting element (20, 20') having, in operation, a light output which is relatively low in comparison with the light output of the first light-emitting element, and means for supplying electrical power to the integrated light source, characterized in that said means for supplying consists of a single means for receiving electrical power from a user-controllable source and supplying power to said light-emitting elements, and said single means comprises means (40), responsive to a sequential change in voltage applied to said single means between two states, for switching one only of said light emitting elements (10, 20, 20') on, or switching at least the other of the light emitting elements (10, 20, 20') on, wherein one of said states is a state in which voltage is applied to said single means, and the other of said states is the state in which voltage is not applied to said single means.

10. The integrated light source claimed in claim 9, characterized in that said means for switching (40) is responsive to a time that elapses between removal of said voltage and application of said voltage.

11. The integrated light source claimed in claim 10, characterized in that upon application of said voltage to said single means after a lapse of time greater than a given time, said means for switching turns only one of said light-emitting elements on.

12. The integrated light source claimed in claim 11, characterized in that upon application of said voltage to said single means after a lapse of time less than said given time, said means for switching turns both light-emitting elements on.

13. The integrated light source claimed in claim 11, characterized in that upon application of said voltage to said single means after a lapse of time less than said given time, said means for switching turns only the other of said light-emitting elements on.

14. The integrated light source claimed in claim 11, characterized in that said one of said light-emitting elements is said second light-emitting element.

15. The integrated light source claimed in claim 9, characterized in that said first light-emitting element comprises a low-pressure mercury vapor discharge vessel (10), and the second light-emitting element comprises at least one light-emitting diode (20, 20').

16. The integrated light source claimed in claim 15, characterized in that said means for switching is responsive to a time that elapses between one of said states and the other of said states.

17. The integrated light source claimed in claim 15, characterized in that upon application of said voltage to said single means after a lapse of time greater than a given time, said means for switching turns only one of said light-emitting elements on.

18. The integrated light source claimed in claim 17, characterized in that said one of said light-emitting elements is said second light-emitting element.

19. The integrated light source claimed in claim 17, characterized in that upon application of said voltage to said single means after a lapse of time less than said given time, said means for switching turns both light-emitting elements on.

20. The integrated light source claimed in claim 19, characterized in that upon application of said voltage to said single means after a lapse of time less than said given time, said means for switching turns only the first light-emitting element on.

* * * * *